US005256069A

United States Patent [19]

Snowden, Jr. et al.

[11] Patent Number: 5,256,069

[45] Date of Patent: Oct. 26, 1993

[54] BOXING DUMMY APPARATUS

[76] Inventors: Donald T. Snowden, Jr.; Yolanda R. Snowden, both of 54 Boerum St. #20A, Brooklyn, N.Y. 11206

[21] Appl. No.: 952,317

[22] Filed: Sep. 28, 1992

[51] Int. Cl.[5] ..... A63B 69/00; G09B 9/00

[52] U.S. Cl. ..... 434/247; 482/83

[58] Field of Search ..... 482/83, 86, 87, 89; 434/247, 257, 256

[56] References Cited

U.S. PATENT DOCUMENTS

| | | | |
|---|---|---|---|
| 1,267,678 | 5/1918 | McArdle | 482/89 |
| 2,253,758 | 8/1941 | Bulloch | 482/83 |
| 2,909,370 | 10/1959 | Fortney | 482/83 |
| 3,888,481 | 6/1975 | Adams, Jr. et al. | 434/247 X |
| 4,593,900 | 6/1986 | Burke | 482/83 |
| 4,932,652 | 6/1990 | Beall, III | 482/83 |

*Primary Examiner*—Gene Mancene
*Assistant Examiner*—Cindy A. Cherichetti
*Attorney, Agent, or Firm*—Leon Gilden

[57] ABSTRACT

A boxing dummy is arranged for wall and floor mounting having a torso, with the torso including appendages directed forwardly of the torso, and a head member spring mounted to the torso portion in a coaxially aligned relationship. Each of the appendages includes an impact receiving pad, with the impact receiving pad formed of a plurality of concentric polymeric rings of varying hardness.

6 Claims, 4 Drawing Sheets

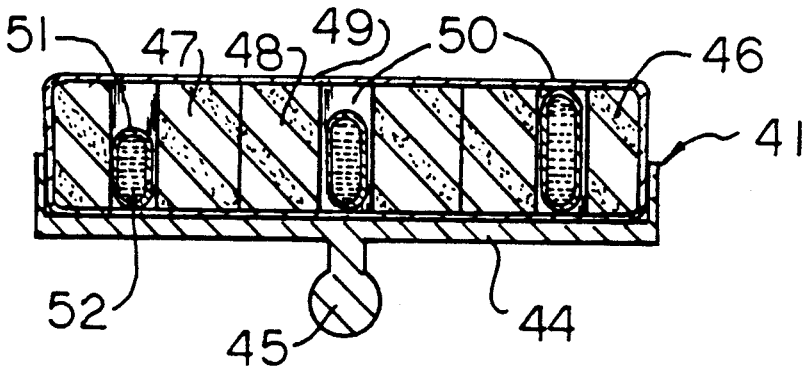
FIG 7
FIG 8
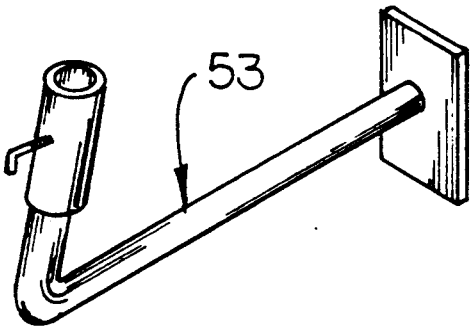
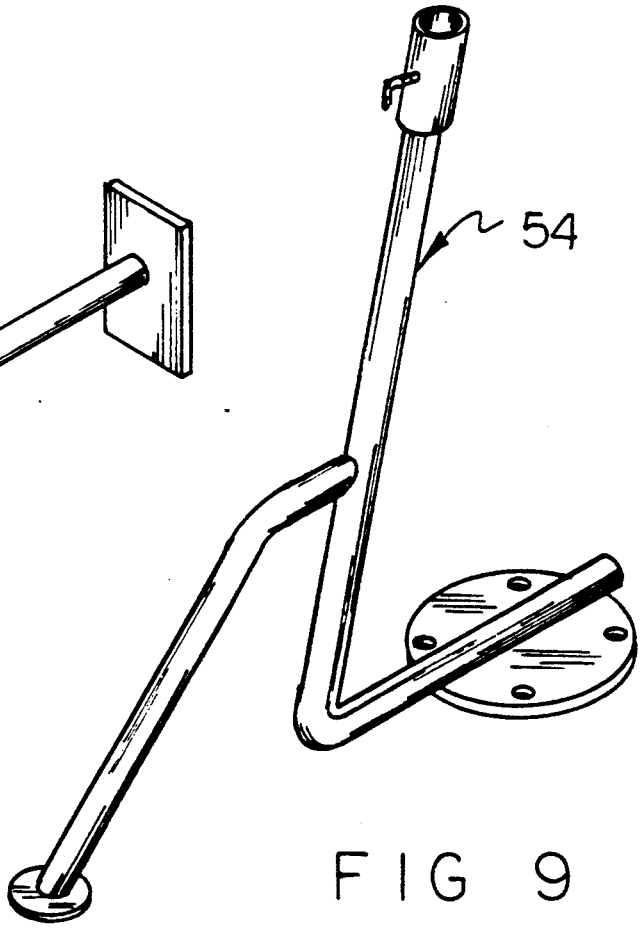
FIG 9

BOXING DUMMY APPARATUS

BACKGROUND OF THE INVENTION

1. Field of the Invention

The field of the invention relates to boxing and training apparatus, and more particularly pertains to a new and improved boxing dummy apparatus wherein the same is arranged to accommodate impact in a boxing training situation.

2. Description of the Prior Art

Various metal arts and training bag structure is available in the prior art such as indicated in U.S. Pat. No. 4,491,315 having a training bag for boxing utilizing a plurality of separate anatomical sections to represent the head and body portion.

The U.S. Pat. Nos. 4,653,746 and 4,940,228 further examples of boxing training structure.

The instant invention attempts to overcome deficiencies of the prior art by providing for a boxing dummy structure arranged to accommodate impact throughout various components of the boxing dummy structure in a manner to simulate a sparring partner or opponent in a boxing environment and in this respect, the present invention substantially fulfills this need.

SUMMARY OF THE INVENTION

In view of the foregoing disadvantages inherent in the known type of boxing and training apparatus now present in the prior art, the present invention provides a boxing dummy apparatus wherein the same is arranged to simulate a boxing opponent. As such, the general purpose of the present invention, which will be described subsequently in greater detail, is to provide a new and improved boxing dummy apparatus which has all the advantages of the prior art martial arts and boxing training apparatus and none of the disadvantages.

To attain this, the present invention provides a boxing dummy arranged for wall and floor mounting having a torso, with the torso including appendages directed forwardly of the torso, and a head member spring mounted to the torso portion in a coaxially aligned relationship. Each of the appendages includes an impact receiving pad, with the impact receiving pad formed of a plurality of concentric polymeric rings of varying hardness.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and system for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boxing dummy apparatus which has all the advantages of the prior art boxing and training apparatus and none of the disadvantages.

It is another object of the present invention to provide a new and improved boxing dummy apparatus which may be easily and efficiently manufactured and marketed.

It is a further object of the present invention to provide a new and improved boxing dummy apparatus which is of a durable and reliable construction.

An even further object of the present invention is to provide a new and improved boxing dummy apparatus which is susceptible of a low cost of manufacture with regard to both materials and labor, and which accordingly is then susceptible of low prices of sale to the consuming public, thereby making such boxing dummy apparatus economically available to the buying public.

Still yet another object of the present invention is to provide a new and improved boxing dummy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic view taken along the lines 7—7 of FIG. 6 in the direction indicated by the arrows.

FIG. 8 is an isometric illustration of a modified wall bracket structure.

FIG. 9 is an isometric illustration of a modified floor bracket structure.

DESCRIPTION OF THE PREFERRED EMBODIMENT

Figure 2:
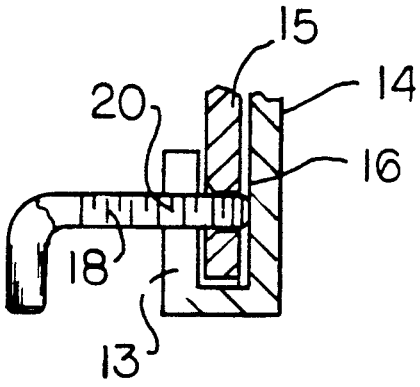
FIG. 2 is an orthographic view, taken along the lines 2—2 of FIG. 1 in the direction indicated by the arrows.

With reference now to the drawings, and in particular to FIGS. 1 to 9 thereof, a new and improved boxing dummy apparatus embodying the principles and concepts of the present invention and generally designated by the reference numeral 10 will be described.

More specifically, the boxing dummy apparatus 10 of the instant invention essentially comprises a wall support bracket 11 cooperative with a floor plate bracket structure to mount the organization relative to a support wall "W" and a support floor "F" in a simultaneous manner. The wall support bracket 11 includes a first L-shaped flange 12 arranged in a parallel, coextensive, and confronting relationship relative to a second L-shaped flange 13 in a generally mirror image relationship relative to one another fixedly mounted orthogonally to opposed sides of a wall bracket base plate 14 to define a guide track 16 between the first and second L-shaped flanges 12 and 13 and the base plate 14. A slide plate 15 is longitudinally received in an adjustable manner along the guide track 16, wherein respective first and second clamp rods 17 and 18 are arranged in a parallel relationship relative to one another and directed through the respective first and second L-shaped flanges 12 and 13 and threadedly directed through the slide plate 15 to impose upon the wall bracket base plate 14, with the first and second clamp rods 17 and 18 received through one of a row of respective first and second apertures 19 and 20 directed through the respective first and second L-shaped flanges 12 and 13.

Figure 1:
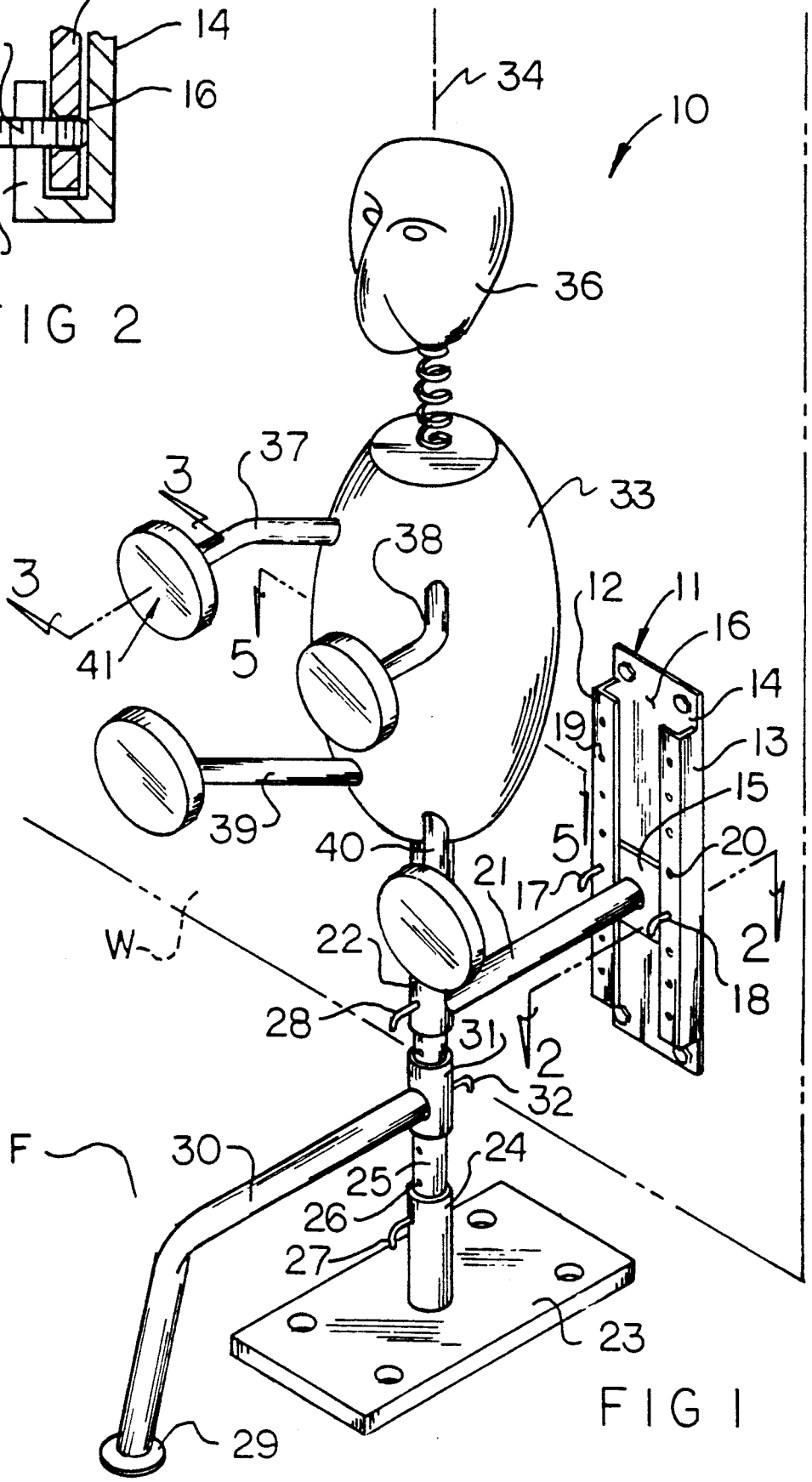
FIG. 1 is an isometric illustration of the instant invention.
Figure 3:
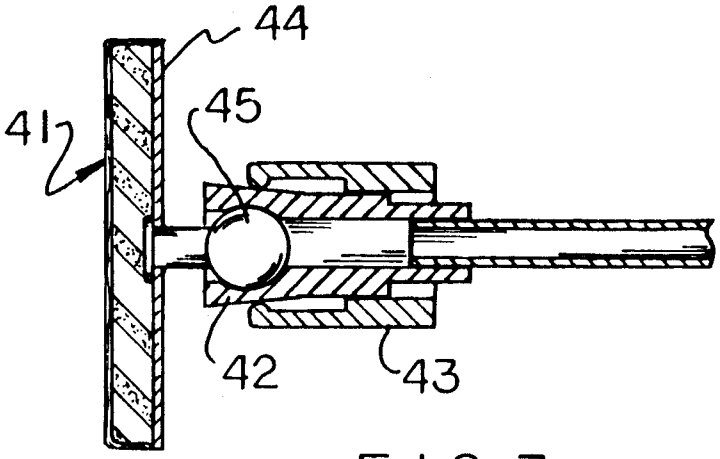
FIG. 3 is an orthographic view, taken along the lines 3—3 of FIG. 1 in the direction indicated by the arrows.
Figure 4:
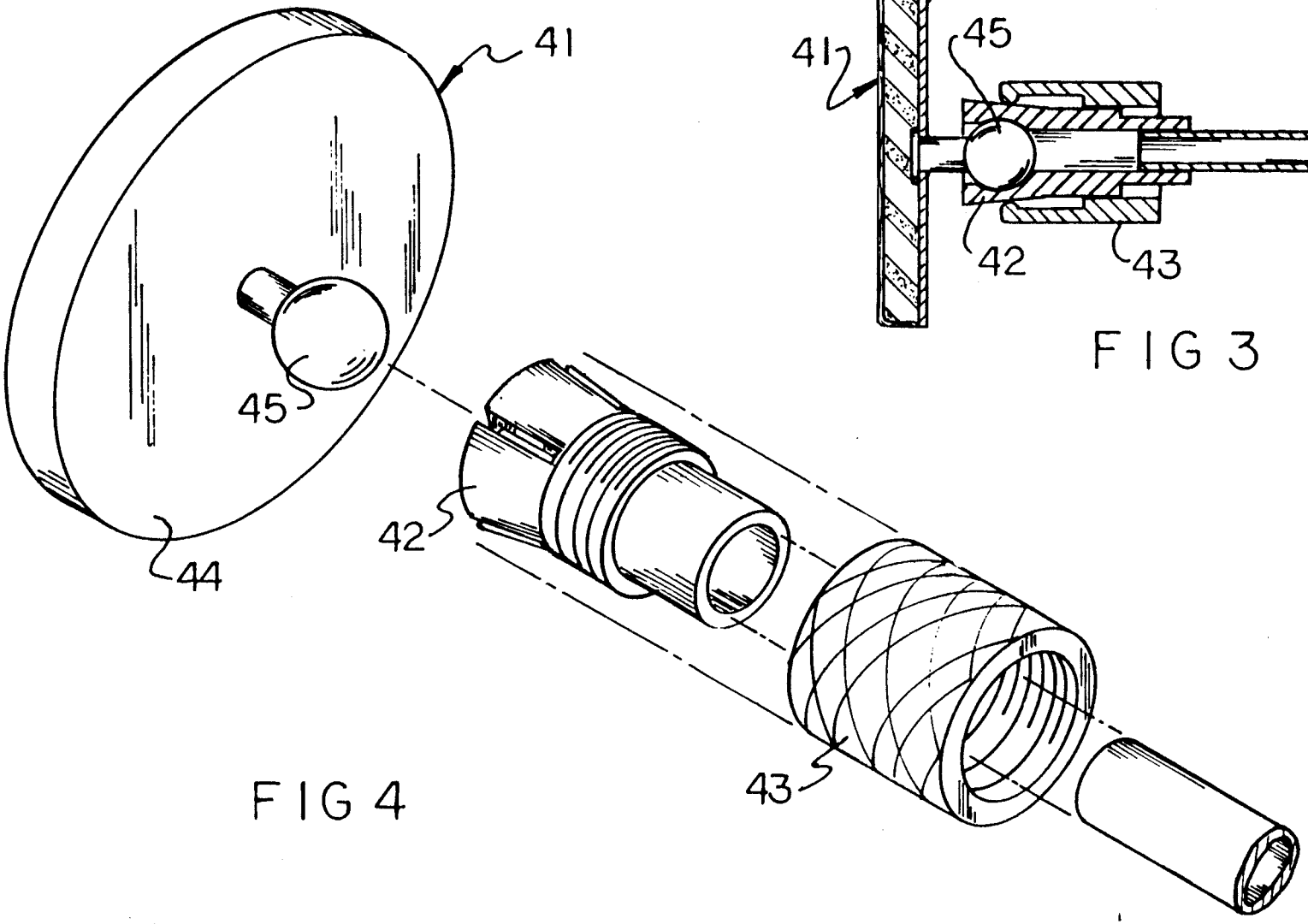
FIG. 4 is an orthographic cross-sectional illustration of the collect structure utilized to mount each abutment and impact pad of the invention.
Figure 5:
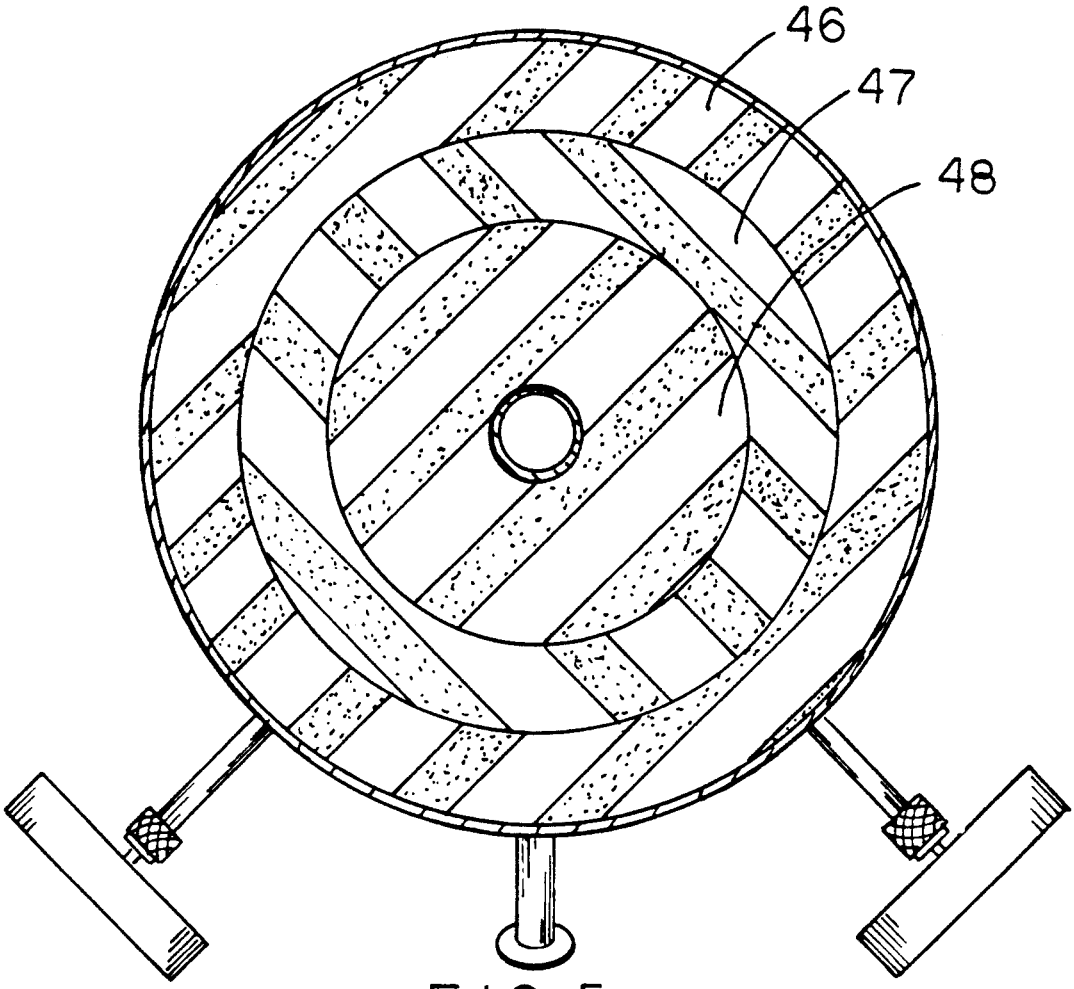
FIG. 5 is an orthographic view, taken along the lines 5—5 of FIG. 1 in the direction indicated by the arrows.

The slide plate 15 includes a slide plate rod 21 fixedly and orthogonally mounted to the slide plate 15 projecting exteriorly of the wall support bracket 11 and having a support tube 22 orthogonally mounted to an outer distal end of the slide plate rod 21. A first floor plate 23 is mounted to the floor "F", having a first floor plate tube 24 fixedly and orthogonally mounted thereon, with a positioning rod 25 having a row of positioning rod apertures 26 directed therethrough, with the positioning rod 25 received within the first floor plate tube 24 and the positioning rod receiving the support tube 22 in a coaxially aligned relationship relative to and spaced from the floor plate tube 24. A third clamp rod 27 is directed through the floor plate tube 24 into one of the positioning rod apertures 26, with a fourth clamp rod 28 directed through the support tube 22 directed into a further one of the positioning rod apertures 26, in a manner as indicated in FIG. 1. A second floor plate 29 parallel to the first floor plate 23 is mounted for stability and fixedly secured as required to the floor "F" and includes a second floor plate rod 30 of a generally L-shaped configuration projecting from the second floor plate 29 and terminating in a second floor plate rod tube 31 that receives the positioning rod 25 therethrough between the support tube 22 and the first floor plate tube 24, with a fourth clamp rod 32 directed through the second floor plate rod tube 31 in a threaded manner to frictionally engage the first floor plate position rod 25.

A dummy torso member 33 is provided, typically of a polymeric and resilient construction, having an axis 34, with the support tube 22 fixedly mounted to the torso member 33 coaxially aligned with the axis 34 to a lower distal end of the torso member 33. An upper end of the torso member 33 has a spring 35 mounted thereon mounting a head member 36 in a biased relationship relative to the torso member 33, with the head member 36 and the spring 35 coaxially aligned along the axis 34 in a normal non-displaced orientation, as indicated in FIG. 1.

Respective first and second arm rods 37 and 38 extend from the torso member 33, as well as first and second leg rods 39 and 40 oriented below the respective first and second arm rods 37 and 38. Each of the leg and arm rods terminates in an impact pad 41, with each impact pad arranged in a spaced relationship relative to the torso member 33.

Each of the impact pads 41 includes an impact pad base plate 44, including a spherical member 45 projecting exteriorly thereof received within a collect chuck 42, wherein the collet chuck in turn is tightened by the use of a collet clamp sleeve 43 that in turn is secured to the free distal end of each of the rods 37–40 to permit pivoting orientation of the impact pad of each of the rod members 37–40.

Figure 6:
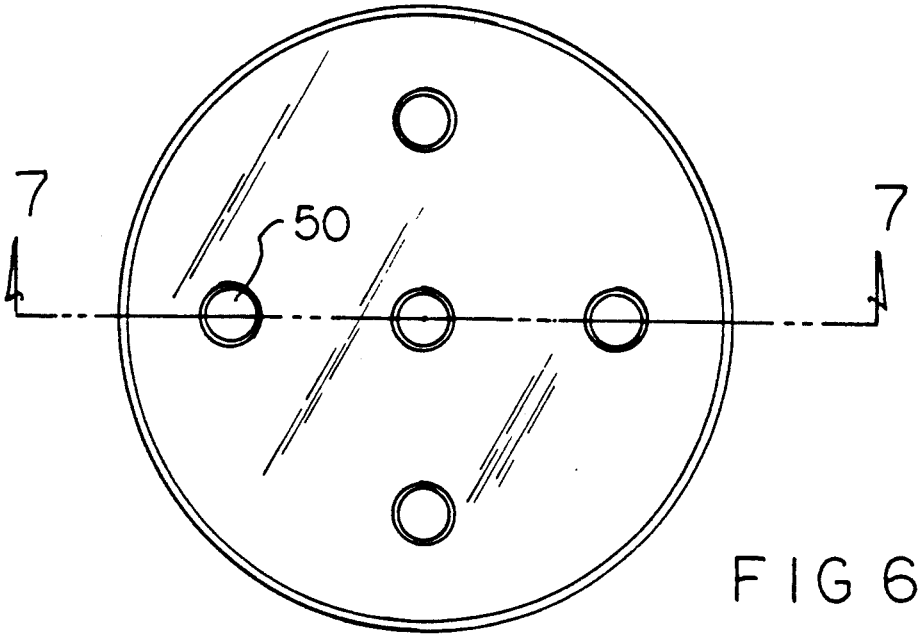
FIG. 6 is an orthographic modified impact pad structure indicating the use of various channels positioned within the impact pad.

Each impact pad is further formed (see FIG. 5) to include an outer resilient ring 46 of a first durometer value, and inner resilient ring 47 concentric with the outer resilient ring 46, with the inner resilient ring 47 of a second durometer value, and a resilient central core 48 concentric with a and medially of the outer and inner rings 46 and 47, with the central core 48 of a third durometer value. The second durometer value is less than the first and third durometer value is less than the second such that the central core is of softer material relative to the inner ring 47, with the inner ring softer than the outer ring 46. An outer porous cover 49 extends over the impact pad to cover various channels so that are orthogonally directed through the outer ring, the inner ring, and the central core 48, as indicated in FIG. 6. Each of the channels includes a dye capsule 51 contained therewithin, wherein each dye capsule may be formed of a varying length relative to other dye capsules within the channels 50, with each dye capsule 51 having a fluid dye 52 therewithin, whereupon impact of sufficient force, the dye capsule is crushed to project fluid for visible ascertaining through the removable and replaceable porous cover 49 to indicate precise portions of impact for a training procedure relative to an individual.

The FIGS. 8 and 9 indicate the use of respective alternate wall and floor plate brackets for optionally employment by the invention as required of a more unitary construction lacking the adjustable features of the bracket structure, as indicated in FIG. 1 if so desired, for economy of manufacture.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A boxing dummy apparatus for mounting to a support wall and simultaneously to a support floor, wherein the apparatus comprises, a wall support bracket arranged for mounting to the support wall, and floor support bracket means for mounting to the support floor, and a positioning rod mounted to the wall support bracket and to the floor support bracket means, with the positioning rod having a particular rod upper distal end, and a dummy torso member formed of a resilient material, with the torso member having a torso member lower distal end mounted to the positioning rod upper distal end, and the torso member upper distal end having a torso spring, and the torso spring including a head member mounted to the torso spring, with the head member arranged in a spaced relationship relative to the torso member.

2. An apparatus as set forth in claim 1 wherein the torso spring, the head member, the torso member, and the positioning rod are coaxially aligned along a predetermined axis.

3. An apparatus as set forth in claim 2 wherein the torso member includes a first arm rod and a second arm rod fixedly mounted to the torso member extending exteriorly thereof, and a first leg rod and a second leg rod mounted to the torso member, with the first leg rod and the second leg rod positioned below the first arm rod and the second arm rod, and each rod of said first arm rod, said second arm rod, said first leg rod, and said second leg rod having a rod free distal end, and each rod free distal end includes a collet member, and each collet member including an impact pad mounted to each collet member, each impact pad having an impact pad base plate, and each impact pad base plate having a spherical member, and each spherical member adjustably mounted within each collet member.

4. An apparatus as set forth in claim 3 wherein each impact pad includes an outer resilient ring having a first durometer value, an inner resilient ring having a second durometer value, and a central core having a third durometer value, wherein the third durometer value is less than the second durometer value and the second durometer value is less than the first durometer value, and the outer ring, the inner ring, and the central core are arranged in a concentric relationship to one another.

5. An apparatus as set forth in claim 4 wherein each impact pad includes a porous outer cover, and each impact pad includes a plurality of dye channels orthogonally oriented relative to said each impact pad base plate, and each dye channel includes a dye capsule contained therewithin, and each dye capsule includes a fluid dye therewithin, wherein each dye capsule is arranged for bursting and projecting through said porous cover.

6. An apparatus as set forth in claim 5 wherein the wall support bracket includes a wall bracket base plate, the wall bracket base plate having a first L-shaped flange and a second L-shaped flange fixedly mounted thereon, wherein the first L-shaped flange and a second L-shaped flange are arranged in a mirror image relationship relative to one another having a guide track therebetween, and a slide plate slidably mounted along the guide track, and the first L-shaped flange and the second L-shaped flange include a respective first clamp rod and a second clamp rod directed therethrough, wherein the first clamp rod and the second clamp rod are orthogonally oriented relative to the wall bracket base plate, and the first clamp rod and the second clamp rod are threadedly received through the slide plate, with the first clamp rod and the second clamp rod arranged for abutment with the wall bracket base plate to fixedly secure the slide plate relative to the wall bracket base plate, and the slide plate having a slide plate rod fixedly and orthogonally mounted to the slide plate extending exteriorly thereof, the slide plate rod having a support tube fixedly mounted to the slide plate rod spaced from the base plate, and the support tube receiving the positioning rod therethrough, and the first support bracket means includes a first floor bracket spaced from a second floor bracket, the first floor bracket including a first floor plate tube, and the floor plate tube receiving a positioning rod therethrough, wherein the floor plate tube is coaxially aligned with the support tube, and the second floor plate having a second floor plate rod extending therefrom, and the second floor plate rod having a second floor plate rod tube positioned between the support tube and the first floor plate tube, with the second floor plate rod tube receiving the positioning rod therethrough.

* * * * *